US008083312B2

(12) United States Patent
Liu et al.

(10) Patent No.: US 8,083,312 B2
(45) Date of Patent: Dec. 27, 2011

(54) MAINTENANCE STATION OF AN INKJET PRINTER

(75) Inventors: Min-Hsi Liu, Hsinchu (TW); Wei-Yuan Peng, Hsinchu (TW); Wei-Fong Lin, Hsinchu (TW); Jui-Yi Yu, Hsinchu (TW)

(73) Assignee: Foxlink Image Technology Co., Ltd., Hsinchu (TW)

( * ) Notice: Subject to any disclaimer, the term of this patent is extended or adjusted under 35 U.S.C. 154(b) by 890 days.

(21) Appl. No.: 12/102,195

(22) Filed: Apr. 14, 2008

(65) Prior Publication Data

US 2009/0256883 A1 Oct. 15, 2009

(51) Int. Cl.
*B41J 2/165* (2006.01)

(52) U.S. Cl. ..... 347/22; 347/29; 347/32

(58) Field of Classification Search ..... 347/22–36
See application file for complete search history.

(56) References Cited

U.S. PATENT DOCUMENTS

2008/0284817 A1* 11/2008 Wu et al. ..... 347/36
* cited by examiner

*Primary Examiner* — Kevin S Wood
(74) *Attorney, Agent, or Firm* — WPAT, P.C.; Anthony King

(57) ABSTRACT

A maintenance station of an inkjet printer mounted in a housing of the inkjet printer includes an ink cup rotationally and slidably coupled to the housing about/along an axis of rotation. The ink cup has a basic plate and a columnar rim around the basic plate. The columnar rim respectively defines a plurality of stopping ratchets and driving ratchets with the same gradient direction at a bottom and top thereof. A moving body is slidably disposed in the housing of the inkjet printer. An actuator movably disposed in the moving body moves together with the moving body, a tail of the actuator stretches out from the moving body for matching with the driving ratchets to rotate the ink cup. A plurality of housing ratchets are disposed in the housing of the inkjet printer and arranged into a ring for matching with the stopping ratchets to prevent the ink cup reversion.

10 Claims, 6 Drawing Sheets

MAINTENANCE STATION OF AN INKJET PRINTER

BACKGROUND OF THE INVENTION

1. Field of the Invention

The present invention relates to an inkjet printer, and more particularly to a maintenance station of an inkjet printer.

2.The Related Art

An inkjet printer requires experimental print before starting to print, and wiping the remnant ink of the printing head of the inkjet printer to keep the printing head clean and covering the printing head to avoid ink evaporating after print. So the inkjet printer is provided with a maintenance station for receiving the ink of the experimental print and cleaning the remnant ink of the printing head.

Reference to FIG. 1, FIG. 2 and FIG. 3, a prior maintenance station is shown. The maintenance station has an ink cup 300' adopted to receive the ink of the experimental print and a pivot 330' configured in the inkjet printer. The ink cup 300+ is pivoted to the pivot 330'. An appropriate space is left between the ink cup 300' and the pivot 330'. The ink cup 300' has a plurality of ratchets 340' extending outward from the edge thereof. An actuator 400' is adopted to push the ratchets 340' to rotate the ink cup 300' so that the ink cup 300' can receive the ink averagely. And a stopping block 430' is adopted to abut to the ratchet 340' of the ink cup 300' to prevent the ink cup 300' from reversing.

When the actuator 400' pushes the ratchet 340' along the direction of the arrow shown in FIG. 2, the ink cup 300' is pushed to the top left because of the space between the ink cup 300' and the pivot 330'. In this process, the interface between the actuator 400' and the ink cup 300' increases gradually, the ink cup 300' separates from the stopping block 430' and is pushed to rotate. When the actuator 400' moves oppositely along the direction of the arrow shown in FIG. 3, the ink cup 300' moves to the bottom right because of the space. At this time, the stopping block 430' abuts the ink cup 300' so that the ink cup 300' cannot reverse.

However, the moving trace of the ink cup 300' is not affirmatory because of the floating position of the ink cup 300' and the changing position of the actuator 400'. Sometimes the interface between the ink cup 300' and the actuator 400' dose not increase or the ink cup 300' does not move to the bottom right when the actuator 400' moves oppositely. As the result, the actuator 400' cannot drive the ink cup 300' rotating effectively and steadily or the ink cup 300' comes into reversing when the actuator 400' withdraws to the initiative position.

SUMMARY OF THE INVENTION

Accordingly, an object of the present invention is to provide a maintenance station of an inkjet printer which can get rid of the problem that the actuator can not drive the ink cup rotating effectively and steadily and that the ink cup comes into reversing when the actuator withdraws to the initiative position.

A maintenance station of an inkjet printer mounted in a housing of the inkjet printer includes an ink cup rotationally and slidably coupled to the housing about/along an axis of rotation. The ink cup has a basic plate and a columnar rim around the basic plate. The columnar rim respectively defines a plurality of stopping ratchets and driving ratchets with the same gradient direction at a bottom and top thereof. A moving body is slidably disposed in the housing of the inkjet printer. An actuator movably disposed in the moving body moves together with the moving body, a tail of the actuator stretches out from the moving body for matching with the driving ratchets to rotate the ink cup. A plurality of housing ratchets are disposed in the housing of the inkjet printer and arranged into a ring for matching with the stopping ratchets to prevent the ink cup reversion.

As described above, the ink cup of the maintenance station of the inkjet printer is pivoted to the housing and can move upward and downward. The actuator is slidably received in the moving body and also can move upward and downward. When the actuator moving together with the moving body pushes the driving ratchet to rotate the ink cup, the actuator matches the driving ratchet of the ink cup, which guarantees the ink cup being driven steadily all the same. When the actuator moves oppositely for withdrawing to the initiative position, the stopping ratchets of the ink cup mating with the housing ratchets can effectively prevent the ink cup from reversion. Thereof, the present invention can avoid the problem that the actuator cannot drive the ink cup rotating effectively and steadily and that the ink cup comes into reversing when the actuator withdraws to the initiative position.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENTS

Figure 1:
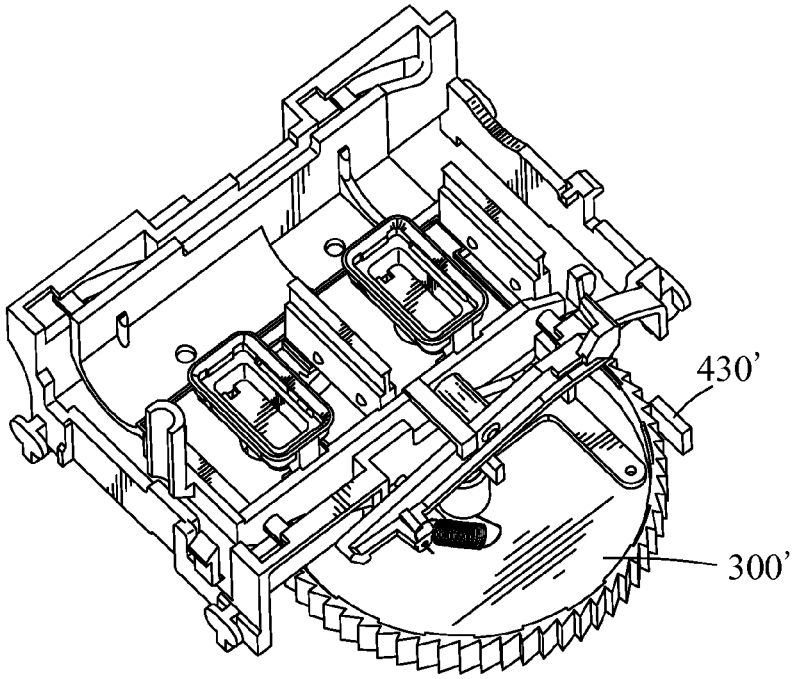
FIG. 1 (Prior Art)
FIG. 1 is a perspective view of a prior maintenance station of an inkjet printer.
Figure 2:
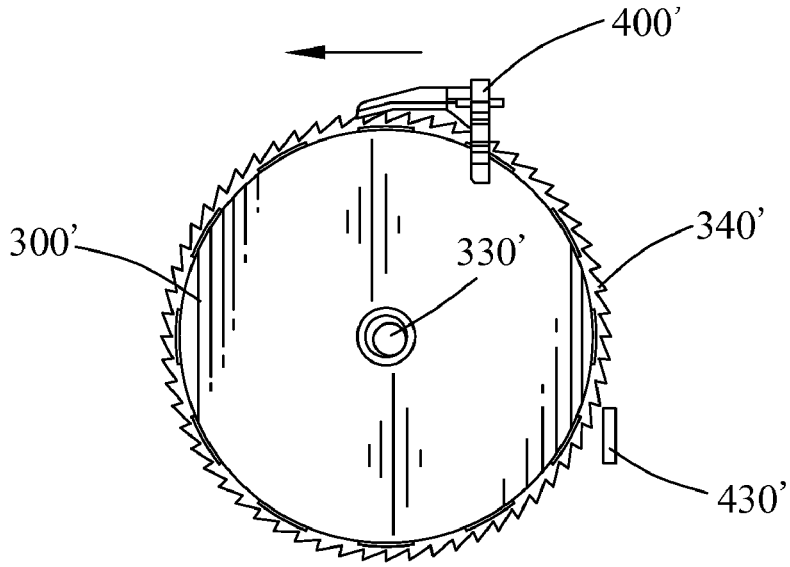
FIG. 2 (Prior Art)
FIG. 2 and FIG. 3 are top views of the prior maintenance station showed in FIG. 1, illustrating the movement of the ink cup.
Figure 3:
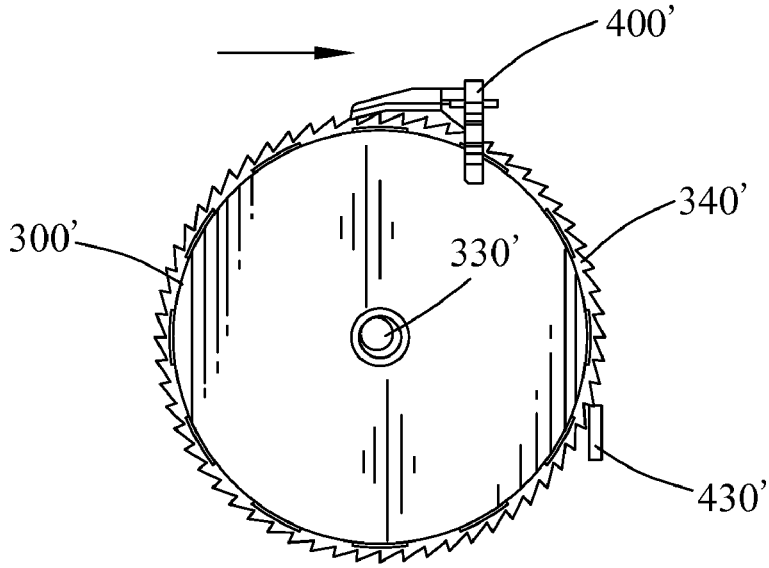
FIG. 3 (Prior Art)
Figure 4:
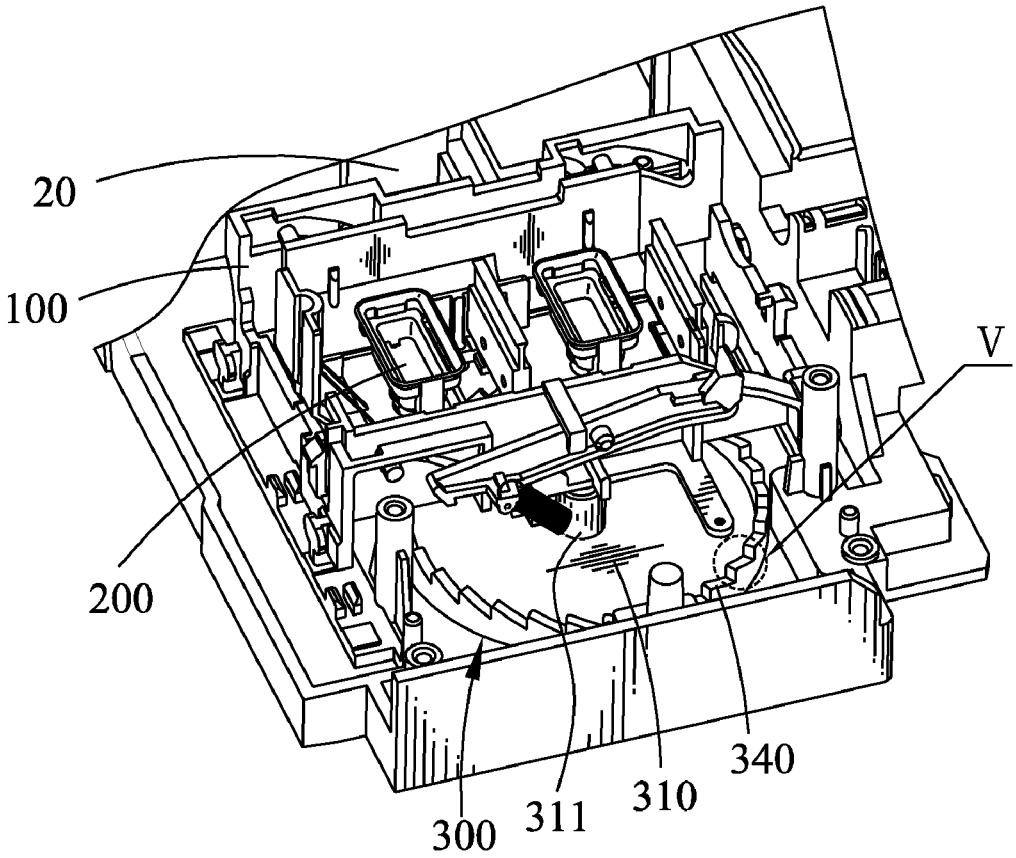
FIG. 4 is perspective view of a maintenance station of an inkjet printer of the present invention, wherein the relevant portions of the housing of the inkjet printer are shown.
Figure 6:
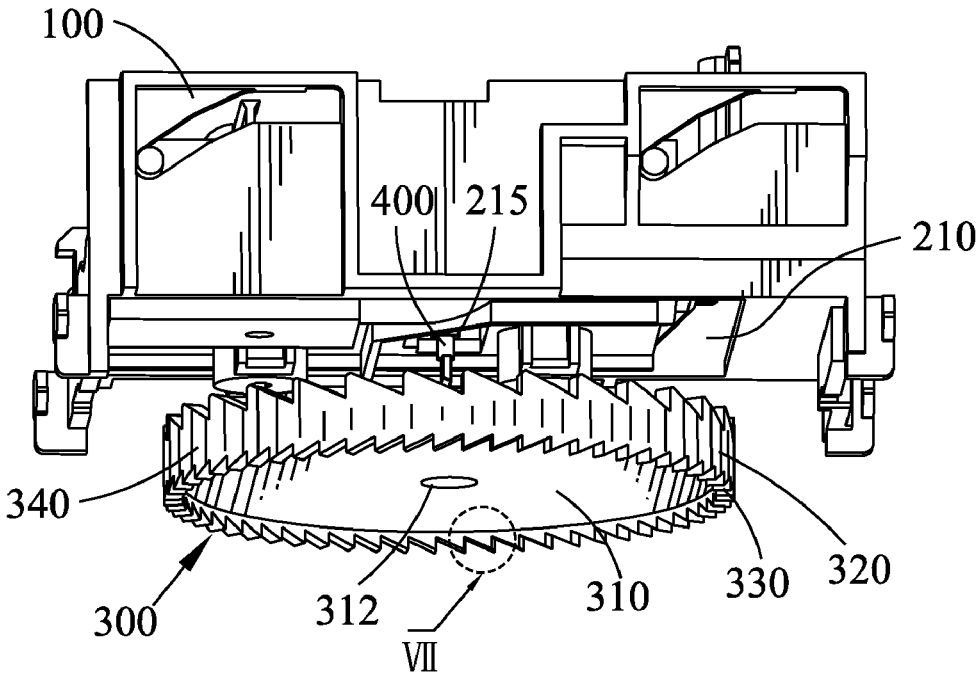
FIG. 6 is another perspective view of the maintenance station of the inkjet printer shown in FIG. 4, where the relevant portions of the housing of the inkjet printer are removed.
Figure 7:
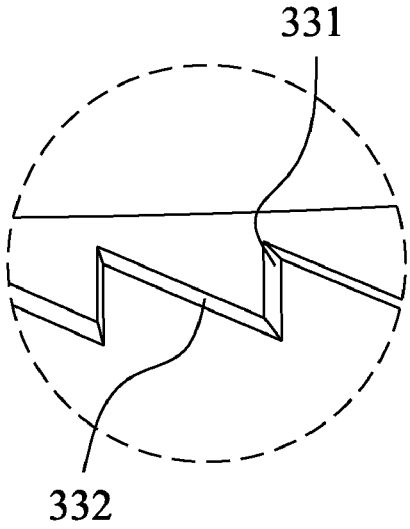
FIG. 7 is a partial perspective view of stopping ratchets of the maintenance station shown in FIG. 6.
Figure 8:
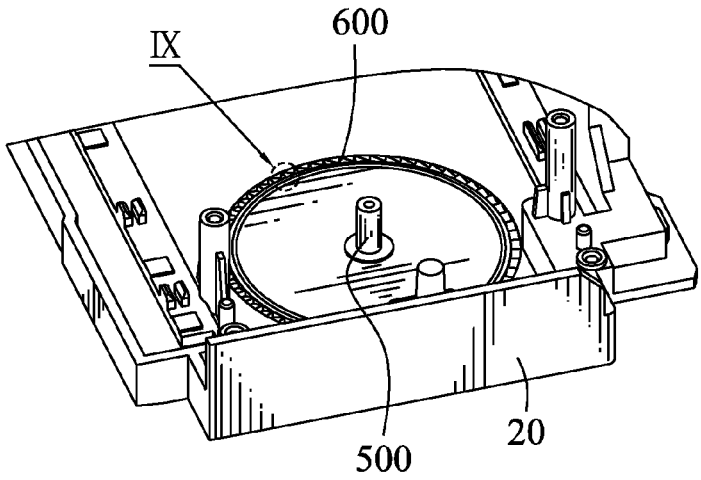
FIG. 8 is a perspective view of the housing of the inkjet printer shown in FIG. 4.

With reference to FIG. 4, FIG. 6 and FIG. 8, a maintenance station of the present invention mounted in a housing 20 of an inkjet printer includes a supporter 100 configured in the housing 20, a maintenance assembly 200 slidably placed on the supporter 100, an actuator 400 movably received in the maintenance assembly 200, a pivot 500 located on the housing 20, a plurality of housing ratchets 600 encircling the pivot 500 fixed on the housing 20 and an ink cup 300 slidably pivoted to the pivot 500.

Figure 9:
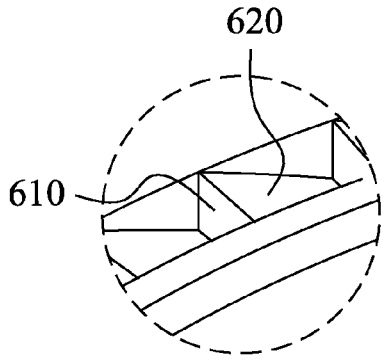
FIG. 9 is a partial perspective view of housing ratchets shown in FIG. 8.

Please reference to FIG. 8 and FIG. 9, the housing ratchets 600 connecting continuously with each other are surroundingly fixed on the housing 20 to form a circle. Each of the housing ratchets 600 has a blocking surface 610 of upright-plane shape and a slippery surface 620 of gradient-plane shape connecting with each other. The pivot 500 protrudes outward from the housing 20 and is located at the center of the circle formed by the housing ratchets 600.

Figure 10:
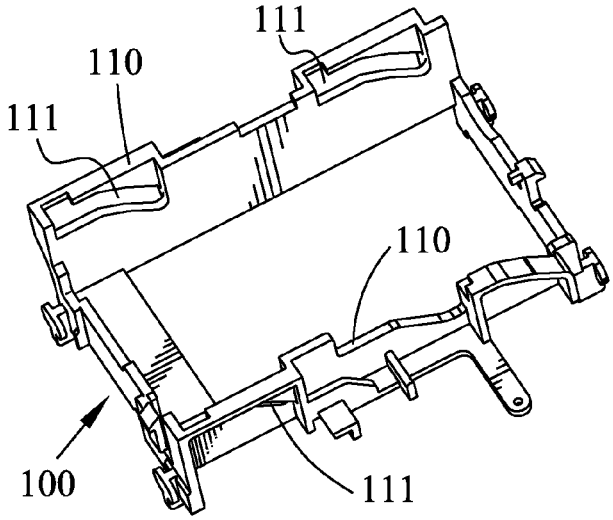
FIG. 10 is a perspective view of a supporter of the maintenance station shown in FIG. 4.
Figure 11:
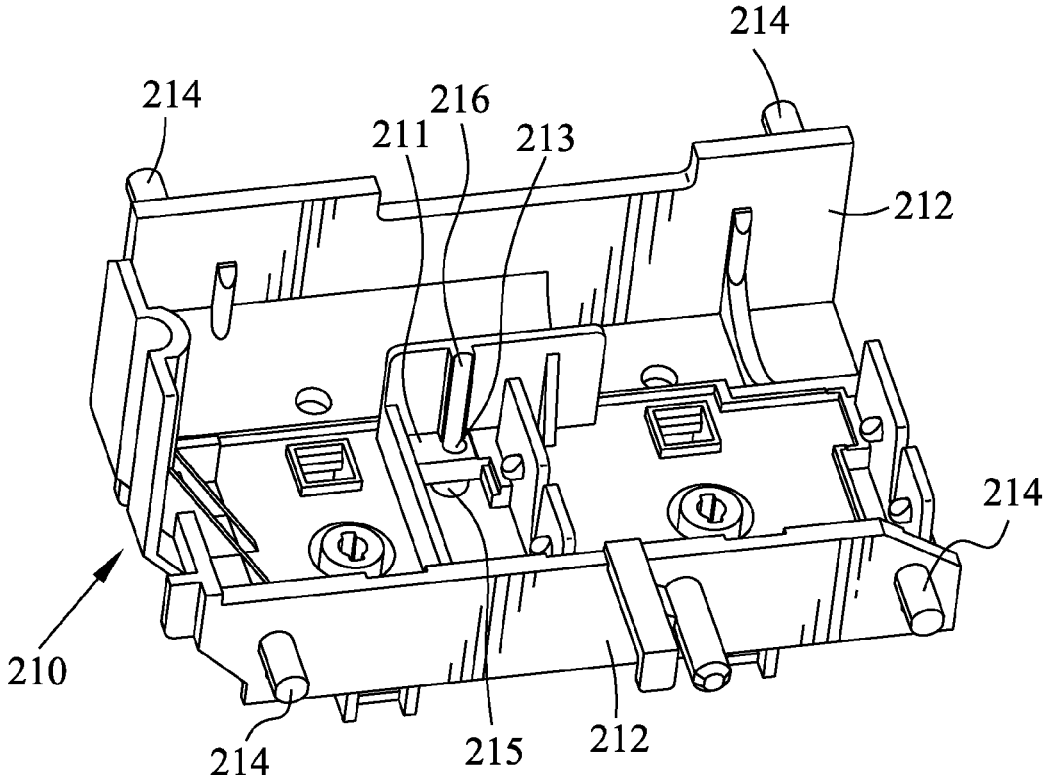
FIG. 11 is a perspective view of a moving body of the maintenance station shown in FIG. 4.

Please reference to the FIG. 4, FIG. 10 and FIG. 11, the supporter 100 has a pair of holding plates 110 at two sides thereof. Each of the holding plate 110 has two slots 111 arranged in series and extending toward the bottom right to form an arc shape. The maintenance assembly 200 has a moving body 210. The moving body 210 includes a basic plate 211 and a pair of side plates 212 extending upward vertically from front and rear edges of the basic plate 211 respectively. Each of the side plate 212 provides a pair of sliding bars 214 which are inserted into the corresponding slots 111 to lead the moving body 210 to slide therein. A bottom surface of the basic plate 211 extends downward to form a hole base 215. An actuating hole 213 is opened to pass through the basic plate 211 and the hole base 215. The basic plate 211 has an extension portion 216 extending upward from the margin of the actuating hole 213. A surface of the extension portion 216 facing to the actuating hole 213 has a shape consistent with the actuating hole 213 and less than the half of the actuating hole 213.

Please reference to the FIG. 4, FIG. 5, FIG. 6 and FIG. 7, the ink cup 300 has a basic plate 310 and a columnar rim 320 located around the margin of the basic plate 310. The basic plate 310 has a supporter base 311 extending upward at the center thereof. A pivotal hole 312 is opened at a position corresponding to the axis of rotation to pass through the supporter base 311 and the basic plate 310 for pivoting to the pivot 500. The columnar rim 320 is of cylinder shape. A bottom of the columnar rim 320 extends downward to form a plurality of stopping ratchets 330 coupling with the housing ratchets 600. The stopping ratchet 330 has a stopping surface 331 of upright-plane shape coupling with the blocking surface 610 and a sliding surface 332 of gradient-plane shape coupling with the slippery surface 620. A top of the columnar rim 320 extends upward to form a plurality of driving ratchets 340 connecting with each other. The driving ratchet 340 has the same gradient direction with the stopping ratchet 330 and includes a cliffy driving surface 341 of upright-plane shape, a glacis surface 342 and an arc surface 343 connecting the cliffy driving surface 341 and the glacis surface 342.

Figure 12:
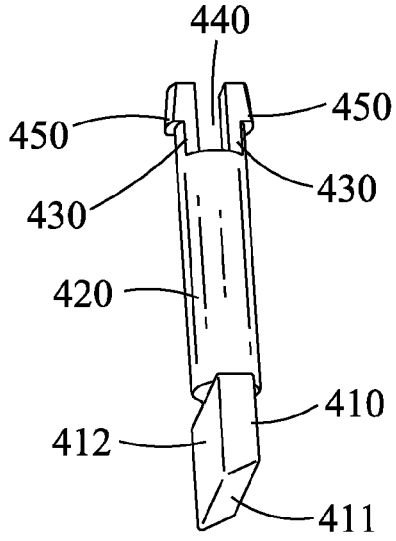
FIG. 12 is a perspective view of an actuator of the maintenance station shown in FIG. 4.

Please reference to the FIG. 6 and FIG. 12, the actuator 400 slidably mounted in the actuating hole 213 has a cylinder portion 420 and a pushing portion 410 formed at a bottom end of the cylinder portion 420. The cylinder portion 420 extends upward to form two facing elastic portions 430 at the edge thereof. An upper portion of the elastic portion 430 extends outward to form a stopping lump 450. A recess 440 is formed between the two elastic portions 430 to assure the elastic portions 430 of the actuator 400 elastically passing through the actuating hole 213. Then the stopping lumps 450 are against an abutting region of the top of the actuating hole 213 for supporting the actuator 400 and are against two sides of the extension portion 216 for preventing the actuator 400 from rotating. The pushing portion 410 of oblong shape has a pushing surface 412 of upright-plane shape at one side thereof and a sliding surface 411 at the bottom thereof. The pushing surface 412 and the sliding surface 411 define an acute included angle and can engage with the cliffy driving surface 341 and the glacis surface 342 respectively.

Figure 5:
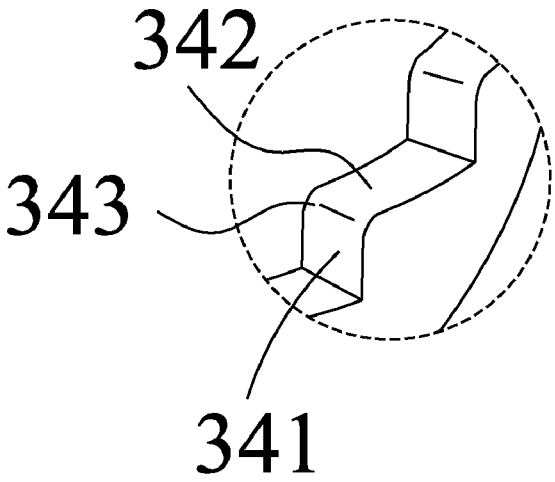
FIG. 5 is a partial perspective view of driving ratchets of the maintenance station shown in FIG. 4.

Please reference to the FIG. 5 and FIG. 6, when the inkjet printer begins to experimentally print, the moving body 210 is driven to move toward the bottom right along the slots 111 of the holding plate 110. In this process, the actuator 400 pushes the cliffy driving surface 341 of the driving ratchet 340 to move and accompanies with the ink cup 300 moving upward and downward because of the stopping ratchets 330 sliding on the housing ratchets 600, accordingly, the ink cup 300 begins to rotate and receive the experimental ink. When the actuator 400 needs to withdraw to the initiative position, the moving body 210 moves toward the top left along the slots 111 of the holding plate 110. In this process, the sliding surface 411 of the actuator 400 slides smoothly on the adjacent glacis surface 342 of the adjacent driving ratchet 340 along the gradient direction of the driving ratchet 340 and then falls down to back to the initiative position and face the cliffy driving surface 341 of the adjacent driving ratchet 340, wherein the arc surface 343 is adopted to guarantee the actuator 400 sliding smoothly and steadily. Meanwhile, the ink cup 300 can keep immobile because of the housing ratchets 600 mating with the stopping ratchets 330 to block the ink cup 300 reversing.

As described above, the ink cup 300 of the maintenance station of the inkjet printer is pivoted to the housing 20 and can move upward and downward. The actuator 400 is slidably received in the moving body 210 and also can move upward and downward. When the actuator 400 moving together with the moving body 210 pushes the driving ratchet 340 to rotate the ink cup 300, the actuator 400 matches the driving ratchet 340 of the ink cup 300, which guarantees the ink cup 300 being driven steadily all the same. When the actuator 400 moves oppositely for withdrawing to the initiative position, the stopping ratchets 330 of the ink cup 300 mating with the housing ratchets 600 can effectively prevents the ink cup 300 from reserving. Thereof, the present invention can avoid the problem that the actuator 400 cannot drive the ink cup 300 rotating effectively and steadily and that the ink cup 300 comes into reversing when the actuator 400 withdraws to the initiative position.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A maintenance station of an inkjet printer mounted in a housing of the inkjet printer, the maintenance station comprising:

an ink cup rotationally and slidably coupled to the housing about/along an axis of rotation, the ink cup having a basic plate and a columnar rim around the basic plate, a bottom of the columnar rim defining a plurality of stopping ratchets, a top of the columnar rim defining a plurality of driving ratchets, the driving ratchet and the stopping ratchet having the same gradient direction;

a moving body slidably disposed in the housing of the inkjet printer;

an actuator movably disposed in the moving body up and down and moving together with the moving body, a tail of the actuator stretching out from the moving body for matching with the driving ratchets to rotate the ink cup; and a plurality of housing ratchets disposed in the housing of the inkjet printer and arranged into a ring for matching with the stopping ratchets to prevent the ink cup reversion.

2. The maintenance station of the inkjet printer as claimed in claim 1, wherein the housing of the inkjet printer forms a pivot at a center of the ring, and the ink cup defines a pivotal hole at a position corresponding to the axis of rotation for engaging the pivot.

3. The maintenance station of the inkjet printer as claimed in claim 1, wherein the moving body defines an actuating hole, the actuator is slidably received in the actuating hole.

4. The maintenance station of the inkjet printer as claimed in claim 3, wherein the tail of the actuator is a pushing portion extending out from the actuating hole to cooperate with the driving ratchet.

5. The maintenance station of the inkjet printer as claimed in claim 4, wherein each of the driving ratchets has a cliffy driving surface and a glacis surface connecting each other smoothly, the pushing portion of the actuator has a pushing surface at one side thereof and a sliding surface at a bottom thereof, the pushing surface and the sliding surface define an acute included angle and engage with the cliffy driving surface and the glacis surface respectively.

6. The maintenance station of the inkjet printer as claimed in claim 3, wherein a top of the actuator defines two facing elastic portions, a stopping lump protrudes outward from an upper portion of the elastic portion for being against an abutting region of the top of the actuating hole.

7. The maintenance station of the inkjet printer as claimed in claim 6, wherein the basic plate has an extension portion extending upward from the margin of the actuating hole, a surface of the extension portion facing to the actuating hole has a shape consistent with the actuating hole, the stopping lumps are against two sides of the extension portion.

8. The maintenance station of the inkjet printer as claimed in claim 1, further comprising a supporter disposed in the housing, the moving body being slidably disposed on the supporter.

9. The maintenance station of the inkjet printer as claimed in claim 8, wherein two sides of the supporter defines a plurality of slots, two sides of the moving body protrude outward to form a plurality of sliding bars slidably engaging with the respective slots.

10. The maintenance station of the inkjet printer as claimed in claim 9, wherein the slot of the supporter inclines downward smoothly from one side to the other side thereof to guide the moving body moving in up and down direction for enabling the actuator to match the driving ratchet more credibly.

* * * * *